US007819988B2

(12) United States Patent
Cui et al.

(10) Patent No.: US 7,819,988 B2
(45) Date of Patent: Oct. 26, 2010

(54) METHOD OF PRODUCING COBALT-PLATINUM MAGNETIC ALLOYS WITH IMPROVED MAGNETIC PROPERTIES

(75) Inventors: Baozhi Cui, Tallahassee, FL (US); Ke Han, Tallahassee, FL (US)

(73) Assignee: Florida State University Research Foundation, Tallahassee, FL (US)

( * ) Notice: Subject to any disclaimer, the term of this patent is extended or adjusted under 35 U.S.C. 154(b) by 317 days.

(21) Appl. No.: 12/077,392

(22) Filed: Mar. 19, 2008

(65) Prior Publication Data

US 2008/0232997 A1 Sep. 25, 2008

Related U.S. Application Data

(60) Provisional application No. 60/918,983, filed on Mar. 20, 2007.

(51) Int. Cl.
*H01F 1/04* (2006.01)
*H01F 1/047* (2006.01)

(52) U.S. Cl. ..... 148/122; 148/121; 148/678

(58) Field of Classification Search ..... None
See application file for complete search history.

(56) References Cited

U.S. PATENT DOCUMENTS 2,622,050 A * 12/1952 Martin et al. ..... 148/102
4,983,230 A * 1/1991 Overfelt et al. ..... 148/300

* cited by examiner

*Primary Examiner*—John P Sheehan
(74) *Attorney, Agent, or Firm*—J. Wiley Horton

(57) ABSTRACT

A method for processing CoPt alloys with improved magnetic properties. The method includes sealing a sample of a CoPt alloy in an evacuated quartz tube, and heating the alloy to a temperature of approximately 1000 degrees C. to homogenize the alloy for approximately 3 hours. The sample is then cooled at a controlled cooling rate of 120-150 degrees C. per minute to 600 degrees C. The sample is then held at 600 degrees C. for 10 hours to promote isothermal ordering. Finally, the sample is quenched in mineral oil.

11 Claims, 2 Drawing Sheets

METHOD OF PRODUCING COBALT-PLATINUM MAGNETIC ALLOYS WITH IMPROVED MAGNETIC PROPERTIES

CROSS-REFERENCES TO RELATED APPLICATIONS

This is a non-provisional application claiming the benefit—pursuant to 37 C.F.R. section 1.53(c)—of an earlier-filed provisional application. The provisional application listed the same inventors. It was filed on Mar. 20, 2007 and received application Ser. No. 60/918,983.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of magnetic alloys. More specifically, this invention comprises a method for producing cobalt-platinum permanent magnetic alloys with improved magnetic properties.

2. Description of the Related Art

Cobalt-Platinum ("CoPt") alloys are the preferred metal alloys in various instruments that require hard magnetic materials. These magnetic alloys are particularly useful in intravascular navigation and drug delivery applications where magnetic CoPt wires are used to guide catheters through a patient's veins or arteries. These applications often require a magnetic component that has high coercivity ($_iH_c$) but low energy product $(BH)_{max}$, where H is the external magnetic field strength and B is the magnetic induction.

CoPt alloys having the aforementioned properties are generally processed in one of two ways. In one process, the CoPt alloy is heated to a temperature of 950-1000 degrees C. for 3 hours in a protective atmosphere to prevent oxidation. The alloy is then cooled to approximately room temperature before being transferred to a salt bath maintained at 660 degrees C. for one and half hours. The alloy is then either quenched or cooled slowly. The typical magnetic properties for CoPt alloys prepared using this method include a remanence (Br) of approximately 6.4 kGs, a coercivity ($_iH_c$) of approximately 4.8 kOe, an energy product ($(BH)_{max}$) of approximately 9.2 MGOe.

In the second method, the CoPt alloy is heated at 900-1000 degrees C. for 3 hours in a protective atmosphere. The alloy is then cooled to room temperature. After being cooled to room temperature, the alloy is "aged" at a temperature of 500-700 degrees C. for 5-20 hours. The alloy is finally either quenched or cooled slowly. The typical magnetic properties for CoPt alloys prepared using this method are Br=6.3 kGs, $_iH_c$=4.95 kOe, and $(BH)_{max}$=9.0 MGOe.

Conventional processing methods are not perfect and the magnetic alloys produced using conventional processing methods may also be improved. Those skilled in the art know that controlling the cooling rate of CoPt from a temperature of 1000 degrees C. to room temperature is difficult to accomplish and time consuming. The use of a salt bath also results in the production of hazardous vapors. Accordingly, it would be desirable to provide a new processing method for producing CoPt alloys with improved properties while avoiding many of the problems associated with conventional processing techniques.

BRIEF SUMMARY OF THE INVENTION

The present invention is a method for processing CoPt alloys with improved magnetic properties. The method includes sealing a sample of a CoPt alloy in an evacuated quartz tube, and heating the alloy to a temperature of approximately 1000 degrees C. to homogenize the alloy for approximately 3 hours. The sample is then cooled at a controlled cooling rate of 120-150 degrees C. per minute to 600 degrees C. The sample is then held at 600 degrees C. for 10 hours to promote isothermal ordering. Finally, the sample is quenched in mineral oil.

Figure 1:
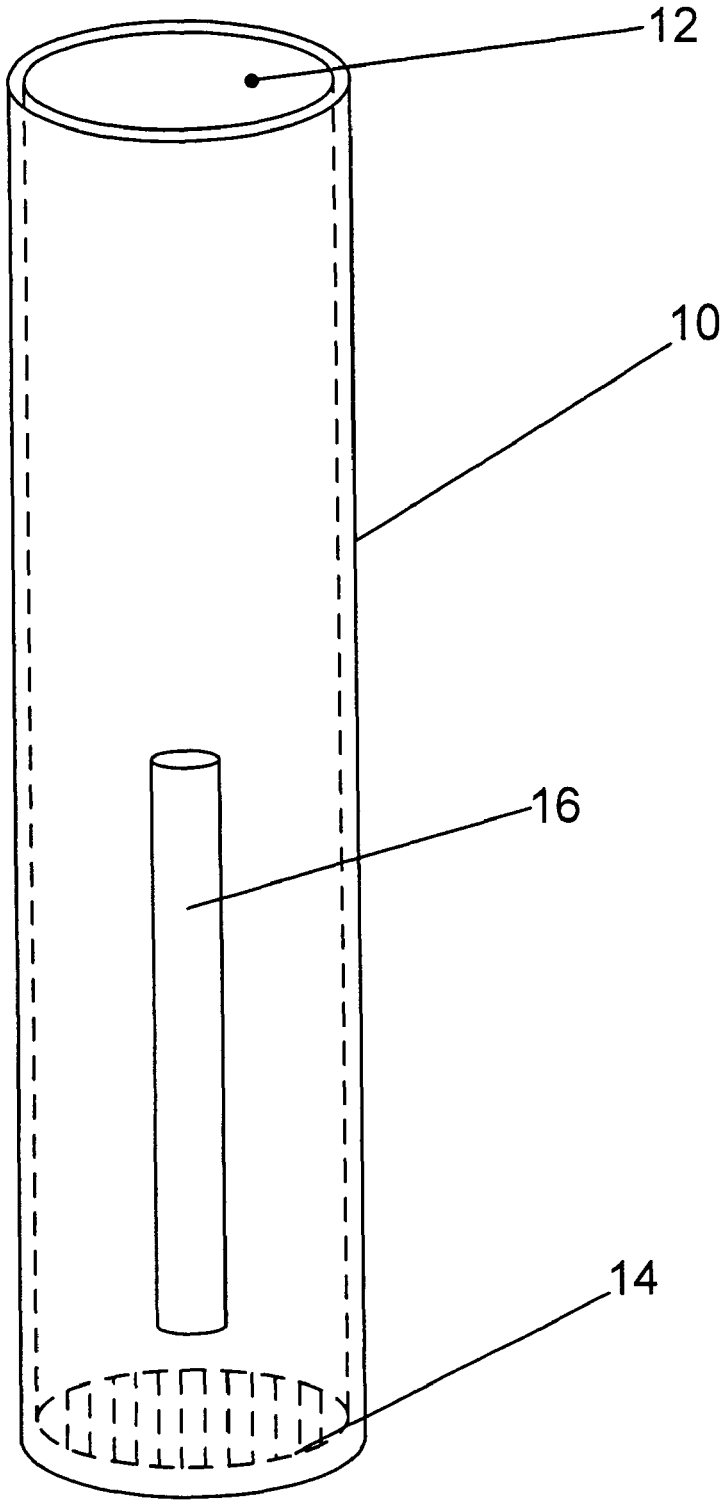
FIG. 1 is a perspective view, showing a sample of a CoPt alloy in an evacuated quartz tube.

| REFERENCE NUMERALS IN THE DRAWINGS | | | |
|---|---|---|---|
| 10 | quartz tube | 12 | open end |
| 14 | closed end | 16 | CoPt sample |

DETAILED DESCRIPTION OF THE INVENTION

A sample of CoPt is first annealed using conventional annealing techniques. The sample is preferably a 50/50 alloy containing equal portions of cobalt and platinum. The sample can be any size that is desired, since sample size does not affect the properties of the sample treated using the present process.

The sample is then placed in a quartz tube as illustrated in FIG. 1. Quartz tube 10 has closed end 14 and open end 12. The quartz tube can be appropriately sized for the desired sample. Representative dimensions would be an inner diameter of 9 mm and an outer diameter of 11 mm. The corresponding CoPt sample 16 has a diameter of approximately 1.6 mm. Once CoPt sample 16 is inserted into quartz tube 10, oxygen is evacuated from quartz tube 10 by vacuuming quartz tube 10 with a mechanical and/or diffusion pump. Open end 12 is then sealed.

The sample is then heated with a 1700° C. tube furnace with heat control provided by a programmable controller. Quartz tube 10 is placed in the center zone of the furnace for heating. The temperature of the furnace is ramped from room temperature to 960° C. at a ramp rate of 15° C. per minute. The temperature is then ramped from 960° C. to 1000° C. at a ramp rate of 4° C. per minute to prevent unintentional temperature overshoot. The furnace is then held at 1000° C. for 3 hours.

The sample is then allowed to cool at a cooling rate of 120-150° C. per minute to 600° C. The sample is then held at 600° C. for 10 hours to promote isothermal ordering. During this part of the process, the CoPt alloy undergoes a phase transformation from the chemically disordered face-centered-cubic structure to a chemically ordered face-centered-tetragonal structure.

The quartz tube is then immediately removed from the furnace and quenched (with the CoPt sample still inside) in a suitable oil—such as mineral oil—until the sample is cooled down to room temperature. The quartz tube is then broken to remove the sample.

The magnetic properties of CoPt alloys produced using the proposed method include a remanence (Br) of approximately 6.9 kGs, a coercivity ($_iH_c$) of approximately 5.6 kOe, an energy product ($(BH)_{max}$) of approximately 8.0 MGOe. These results may vary slightly from one sample to another by as much as 2%. This variation in result is mostly influenced by the quality of the sample (the ratio of cobalt to platinum) rather than the size of the sample. Thus, the proposed process is easily scalable. If bulk samples with large dimension are needed, the CoPt samples need not be sealed in quart tubes. The bulk samples can be heat treated under an argon protective atmosphere or high vacuum (about $1\times10^{-3}$ Pa). The contamination to the bulk samples during quenching can be removed by mechanical grinding.

Figure 2:
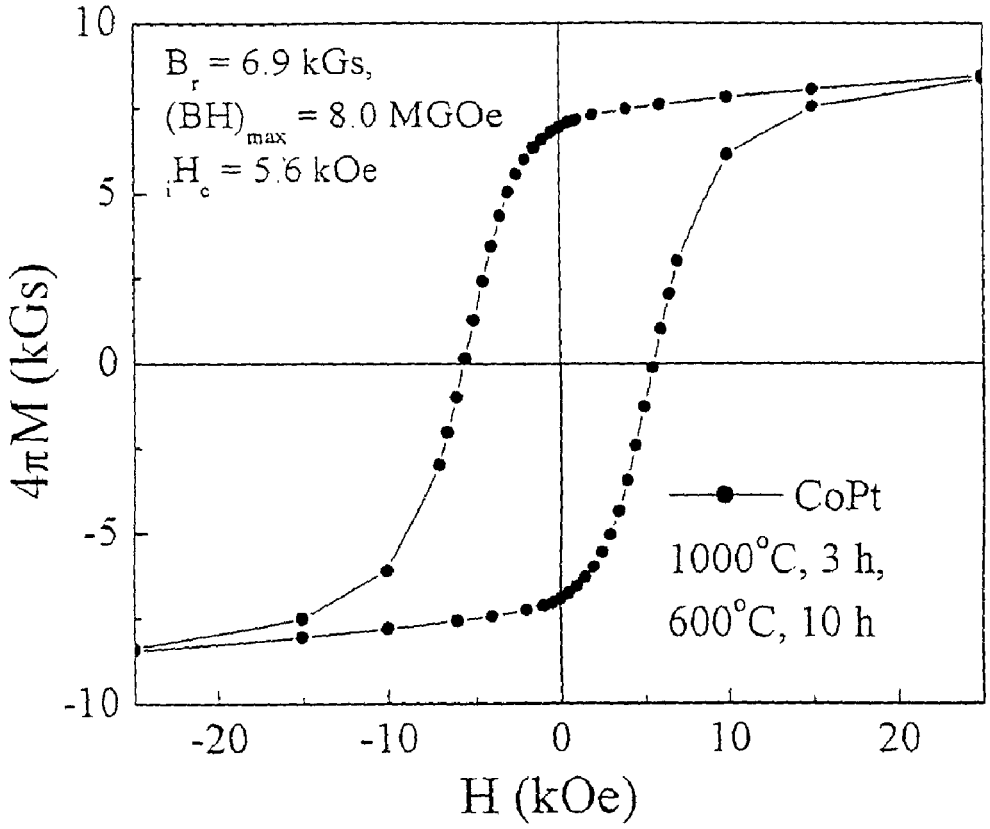
FIG. 2 is an illustration of the hysteresis loop of a sample treated with the present process.

An illustration of hysteresis loop of the resulting sample is provided in FIG. 2. It is noted that the products produced using the present method have a higher coercivity but lower energy product than CoPt samples produced by prior art methods. This is particularly useful in intravascular navigation and drug delivery applications where magnetic CoPt wires are used guide catheters through a patient's veins or arteries.

It is also noted that the proposed process is simpler, more efficient, and has fewer adverse environmental impacts than current processing techniques. The proposed process simplifies the processing procedure by cooling from a high temperature (1000° C.) to 600° C. rather than room temperature with a controlled cooling rate, followed by isothermal ordering at 600° C. The present method avoids the use of salt baths which evaporate hazardous vapors during operation. By sealing the samples in quartz tubes, the samples do not oxidize during heating or become contaminated when quenching in mineral oil.

The preceding description contains significant detail regarding the novel aspects of the present invention. It should not be construed, however, as limiting the scope of the invention but rather as providing illustrations of the preferred embodiments of the invention. Accordingly, the scope of the present invention should be fixed by the following claims rather than any of the specific examples given.

Having described our invention, we claim:

1. A method of making cobalt-platinum alloys, comprising:

a. providing a sample of cobalt-platinum alloy;
b. annealing said sample;
c. placing said annealed sample in an inert atmosphere;
d. placing said annealed sample in said inert atmosphere in a furnace;
e. raising the temperature of said furnace from room temperature to about 960 degrees Celsius at a ramp rate of about 15 degrees Celsius per minute;
f. raising the temperature of said furnace from about 960 degrees Celsius to about 1000 degrees Celsius at a ramp rate of about 4 degrees Celsius per minute;
g. maintaining said sample within said furnace within said inert atmosphere at a temperature of about 1000 degrees Celsius for a period of about 3 hours;
h. cooling said sample within said furnace within said inert atmosphere from a temperature of about 1000 degrees to a temperature of about 600 degrees Celsius at a cooling rate of between about 120 and about 150 degrees Celsius per minute;
i. holding said sample within said furnace within said inert atmosphere at a temperature of about 600 degrees Celsius for a period of about 10 hours; and
j. quenching said sample in a suitable quenching oil to substantially reduce the temperature of said sample.

2. A method as recited in claim 1, wherein said step of placing said annealed sample in an inert atmosphere comprises:

a. providing an enclosure having a closed end and an open end;
b. inserting said annealed sample through said open end into said enclosure;
c. evacuating substantially all the atmosphere within said enclosure; and
d. sealing said open end of said enclosure.

3. A method as recited in claim 2, wherein said enclosure is clear.

4. A method as recited in claim 1, wherein said step of placing said annealed sample in an inert atmosphere comprises:

a. providing an enclosure having an opening;
b. inserting said annealed sample through said opening into said enclosure;
c. filling said enclosure with an inert gas; and
d. sealing said opening so that said annealed sample is immersed in said inert gas within said enclosure.

5. A method as recited in claim 4, wherein said enclosure is clear.

6. A method as recited in claim 2, wherein said step of quenching said sample in a suitable quenching oil comprises:

a. removing said enclosure with said sample inside from said furnace and rapidly placing said enclosure, with said sample inside, into said suitable quenching oil;
b. after said quenching is complete, removing said sample from said enclosure.

7. A method as recited in claim 3, wherein said step of quenching said sample in a suitable quenching oil comprises:

a. removing said enclosure with said sample inside from said furnace and rapidly placing said enclosure, with said sample inside, into said suitable quenching oil;
b. after said quenching is complete, removing said sample from said enclosure.

8. A method as recited in claim 4, wherein said step of quenching said sample in a suitable quenching oil comprises:

a. removing said enclosure with said sample inside from said furnace and rapidly placing said enclosure, with said sample inside, into said suitable quenching oil;
b. after said quenching is complete, removing said sample from said enclosure.

9. A method as recited in claim 4, wherein said step of quenching said sample in a suitable quenching oil comprises:

a. removing said enclosure with said sample inside from said furnace;
b. removing said sample from said enclosure; and
c. placing said sample in said suitable quenching oil.

10. A method as recited in claim 9, further comprising after said sample is placed in said suitable quenching oil, removing said sample from said suitable quenching oil and decontaminating said sample.

11. A method as recited in claim 4, wherein said inert gas is argon.

* * * * *